US011708673B1

(12) United States Patent
Pund

(10) Patent No.: US 11,708,673 B1
(45) Date of Patent: Jul. 25, 2023

(54) ICE CAP WATER COLLECTION AND STORAGE SYSTEM

(71) Applicant: Marvin Louis Pund, Chesterfield, MO (US)

(72) Inventor: Marvin Louis Pund, Chesterfield, MO (US)

( * ) Notice: Subject to any disclaimer, the term of this patent is extended or adjusted under 35 U.S.C. 154(b) by 0 days.

(21) Appl. No.: 18/083,551

(22) Filed: Dec. 18, 2022

(51) Int. Cl.
*E02B 1/00* (2006.01)
*E02B 9/02* (2006.01)
*E02B 3/02* (2006.01)

(52) U.S. Cl.
CPC ..... *E02B 1/00* (2013.01); *E02B 3/02* (2013.01); *E02B 9/02* (2013.01)

(58) Field of Classification Search
CPC ..... E02B 1/00; E02B 3/02; E02B 9/00; E02B 9/02; E02B 9/08
See application file for complete search history.

(56) References Cited

U.S. PATENT DOCUMENTS 2,210,218 A 8/1940 Ramsey
2,962,599 A * 11/1960 Pirkey ..... F03B 13/06 290/43
3,431,735 A * 3/1969 Hans ..... E02B 9/00 405/75
4,132,901 A * 1/1979 Crausbay ..... E02B 9/00 417/330
5,277,585 A * 1/1994 Aminighazvini ..... G09B 25/06 434/152
7,153,060 B1 * 12/2006 Bennion ..... E02B 9/00 405/80
9,797,107 B1 * 10/2017 Huang ..... E02B 9/06
(Continued)

FOREIGN PATENT DOCUMENTS

CH 701735 B1 * 3/2011 ..... E02B 9/02
DE 3841344 A1 * 6/1990 ..... E02B 9/06
EP 2853728 A1 * 4/2015 ..... F03B 13/06

OTHER PUBLICATIONS

Companies are invited to invest in Greenland's largest untapped hydropower potentials, Government of Greenland, Department of Agriculture, Self-Sufficiency, Energy and Environment, May 10, 2022. It is currently available at: hydropower.gl/news/2022/05/world-hydrogen-summit?sc_lang=en.
(Continued)

*Primary Examiner* — Benjamin F Fiorello

(57) ABSTRACT

A reservoir (102) near an ice cap (104), and a graded terrace network (116) on the surface of the ice cap (104). The graded terrace network (116) collects runoff water across a wide area, both within the limits of the reservoir's (102) ice cap natural catchment area (112), and beyond it in the ice cap non-catchment area (114). The graded terrace network (116) directs the collected water into the ice cap natural catchment area (112) and from there it drains into the reservoir's ice-free catchment area (106), and then into the reservoir (102). This increases the volume of water stored in the reservoir (102). This additional stored water is used to power a hydroelectric power station (300) and for other uses. A second reservoir (406), connected to the reservoir (102) by a water pump (402) and a second hydroelectric power station (410), adds additional water storage and power generating capacity.

10 Claims, 4 Drawing Sheets

(56) References Cited

U.S. PATENT DOCUMENTS

| | | | | |
|---|---|---|---|---|
| 2005/0034452 | A1* | 2/2005 | Davis | F03B 3/103 60/398 |
| 2008/0253837 | A1* | 10/2008 | Miller | F03B 13/06 405/80 |
| 2011/0133464 | A1* | 6/2011 | Jankel | E02B 9/00 405/75 |
| 2012/0019004 | A1* | 1/2012 | Ekern | E02B 9/08 290/53 |
| 2014/0270965 | A1* | 9/2014 | Igel, V | F03B 13/06 405/53 |
| 2020/0393184 | A1 | 12/2020 | Pareto et al. | |
| 2021/0333033 | A1 | 10/2021 | Pareto et al. | |

OTHER PUBLICATIONS

Greenland Hydropower Resources. The Data and Reports section of this website contains a link to a PDF file with the title: Tasersiaq, 7e, Greenland Hydropower, which links to Greenland Hydropower Project Site 7e, Prefeasibility Report by Aecom Tecsult Inc. Dec. 2009 It is currently available at: hydropower.gl/emner/data-and-reports?sc_lang=en.

Andreas P. Ahlstrøm et al, Abrupt shift in the observed runoff from the southwestern Greenland ice cap, Sci. Adv. 2017;3: e1701169, Dec. 13, 2017. It is currently available at: www.science.org/doi/10.1126/sciadv.1701169.

Greenland ice sheet topographic map, elevation, terrain (topographic-map.com). It is currently available at: en-gb.topographic-map.com/map-9x6q5k/Greenland-Ice-sheet/?center=66.28985%2C-44.69108&zoom=6&base=5&popup=66.2452%2C-45.57968.

NASA Jet Propulsion Laboratory, California Institute of Technology, GRACE Tellus Gravity Recovery & Climate Experiment, Greenland Ice Loss 2002-2021. It is currently available at: grace.jpl.nasa.gov/resources/30/greenland-ice-loss-2002-2021/.

Philippe Lucas-Picher et al, Very high resolution regional climate model simulations over Greenland: Identifying added value, Journal of Geophysical Research, Atmospherics, vol. 117, Issue D2, Jan. 27, 2012. It is currently available at: agupubs.onlinelibrary.wiley.com/doi/10.1029/2011JD016267.

Clifton Halsey, Modern Terraces for Soil Conservation, Agricultural Extension Service, University of Minnesota, Extension Folder 499-1980. It is currently available at: conservancy.umn.edu/handle/11299/205360.

Melissa Kay Bay, Development of an Online Planning Tool for Designing Terrace Layouts, Master of Science Thesis, University of Missouri, Dec. 2010. It is currently available at: pdfs.semanticscholar.org/2e41/176164c5304d8596ef9d08a5edc7e0dd7c8f.pdf.

Antarctic tracked vehicles website sponsored by the British Antarctic Survey. It is currently available at: www.bas.ac.uk/polar-operations/engineering-and-technology/vehicles/.

Burlak all-terrain vehicle models, includes expedition vehicles, ambulances, tow trucks, services vehicles and others. The website is currently available at: burlakoffroad.com/en/models.

John S. Gulliver et al, Hydropower Engineering Handbook, McGraw-Hill, 1991 It is currently available at: conservancy.umn.edu/handle/11299/195476.

Western HVDC Link description is available on Wikipedia. It is currently available at: en.wikipedia.org/wiki/Western_HVDC_Link.

Case Study Xiangjiaba-Shanghai World's most powerful and longest Ultra HVDC project to go into commercial operation in Jul. 2010, Hitachi Energy Ltd. It is currently available at: www.hitachienergy.com/about-us/case-studies/xiangjiaba---shanghai.

* cited by examiner

ICE CAP WATER COLLECTION AND STORAGE SYSTEM

TECHNICAL FIELD

The present disclosure relates to a system for collection and storage of water and more particularly to the collection and storage of runoff from the surface of an ice cap.

BACKGROUND/SUMMARY

Background Art

The term ice cap refers to an extensive, relatively level area of glacial ice. The term runoff, as used herein, refers to all liquid water that drains naturally from an ice cap. The term ice sheet refers to the two largest ice caps, one in Greenland and the other in Antarctica, that are both larger than 50,000 km^2 (19,300 mi^2) in area. The Greenland ice sheet is also sometimes referred to as the Greenland ice cap. The term ice cap is used herein to refer to both areas of under 50,000 km^2 (19,300 mi^2) and to areas of over 50,000 km^2 (19,300 mi^2) like the Greenland ice cap. Ice caps of under 50,000 km^2 (19,300 mi^2) like the Stikine ice cap can be found in Alaska and elsewhere.

It is known in the prior art that dams have been built to collect runoff from glaciers in numerous locations. These dams collect water that drains from the base of glaciers. Some of these glaciers are outflow glaciers from ice caps. Some of the dams also collect runoff that runs in small natural streams across the surface of glaciers and ice caps and then enters streams in the ice-free zone adjacent to glaciers. The term ice-free zone of an ice cap refers to any terrain near an ice cap that is not covered with ice for the entire year. Some dams that collect runoff are located near ice cap outflow glaciers. Others are located far downstream from the ice cap runoff source. These dams impound runoff that is used for agricultural irrigation, hydroelectric power generation, drinking water, recreation, and numerous other uses. Natural lakes near ice caps also collect natural runoff.

It has been widely reported that the Greenland ice cap is experiencing high rates of ice melting during each summer. The southwestern portion of this ice cap generally experiences the highest rate of melting.

The government of Greenland has identified Tasersiaq Lake, and Tarsartuup Tasersua as two locations that it wishes to see developed as hydroelectric projects. See the following reference: Government of Greenland, Companies are invited to invest in Greenland's largest untapped hydropower potentials, 10 May 2022. It is currently available at: hydropower.gl/news/2022/05/world-hydrogen-summit?sc_lang=en The government of Greenland has a website titled Greenland Hydropower Resources. The Data and Reports section of this website contains a link to a PDF file with the title: Tasersiaq, 7e, Greenland Hydropower, which links to Greenland Hydropower Project Site 7e, Prefeasibility Report by AECOM Tecsult Inc. This is an extensive, 176-page, study of the feasibility of installing a hydropower project at the Tasersiaq Lake site. It is currently available at: hydropower.gl/emner/data-and-reports?sc_lang=en This report describes the installation of two rock fill dams, that collect natural runoff from the Tasersiaq Lake catchment area, and an electrical power generation facility. AECOM Tecsult is a large division of AECOM Technology Corporation a leading provider of professional technical and management support services for government and commercial clients around the world. The Tecsult division specializes in hydropower expertise which it represents as a primary strength of the 1,100-employee division.

Tasersiaq Lake is a large natural lake situated at the western margin of the ice cap in southwestern Greenland. It has been studied to determine the volume of ice cap runoff that enters the lake each year. The term catchment area, as used herein, refers to the entire terrain area from which water drains into a lake or reservoir. A catchment area is also known as a watershed. The Tasersiaq Lake's ice cap catchment area, has been mapped. The map defines the ice cap areas from which runoff naturally drains into the lake. See FIGS. 1 and 3 of the following reference: Andreas P. Ahlstrom, Dorthe Petersen, Peter L. Langen, Michele Citterio, Jason E. Box et al, Abrupt shift in the observed runoff from the southwestern Greenland ice cap, Sci. Adv. 2017; 3: e1701169, 13 Dec. 2017. It is currently available at: www.science.org/doi/10.1126/sciadv.1701169

On a macro scale, the Greenland ice cap topography has a smooth convex profile. The highest elevation regions occur in the north-central region of the ice cap. A high elevation ridge extends south from the high point, dividing the ice cap into similarly sized eastern and western regions. The contour of the southwestern region consists of a gently sloping plane from the central ridge toward the west. The slope increases near the western edge of the ice cap. The southwestern region has a nearly level slope in the north-south direction. See the following reference: Greenland ice cap topographic map, elevation, terrain (topographic-map.com). It is currently available at: en-gb.topographic-map.com/map-9x6q5k/Greenland-Ice-sheet/?center=66.28985%2C-44.69108&zoom=6&base=5&popup=66.2452%2C-45.57968

Examining the detailed topography of smaller areas reveals several types of irregularities. In some areas pressure ridges and crevasses are evident. Shallow lakes appear on the ice cap surface in some areas during the summer melt season. Moulins are openings in the ice cap into which runoff drains during the melt season. Moulins are widely scattered across the ice cap. The elevation differences seen in these irregularities varies from a few meters to tens of meters in elevation change.

The following referenced report shows the annual rate of ice loss on the Greenland ice cap: NASA Jet Propulsion Laboratory, California Institute of Technology, GRACE Tellus Gravity Recovery & Climate Experiment, Greenland Ice Loss 2002-2021. It is currently available at: grace.jpl.nasa.gov/resources/30/greenland-ice-loss-2002-2021/

Two figures, 4c and 4f of the following referenced report show average annual precipitation along the southwestern region of the Greenland ice cap: Philippe Lucas-Picher, Maria Wulff-Nielsen, Jens H. Christensen, Guðfinna Aðalgeirsdóttir, Ruth Mottram, Sebastian B. Simonsen, Very high resolution regional climate model simulations over Greenland: Identifying added value, Journal of Geophysical Research, Atmospherics, Volume 117, Issue D2, 27 Jan. 2012. It is currently available at: agupubs.onlinelibrary.wiley.com/doi/10.1029/2011JD016267

The following two patent applications describe a system for collecting water from mountain springs, streams, aquifers, horizontal wells, or other water sources. Collected water may be diverted to hydroelectric power generators. US20200393184 A1 WATER GATHERING AND DISTRIBUTION SYSTEM AND RELATED TECHNIQUES FOR OPERATING IN FREEZING ENVIRONMENTAL CONDITIONS. US20210333033 A1 WATER GATHERING AND DISTRIBUTION SYSTEM AND RELATED TECHNIQUES FOR OPERATING IN FREEZING ENVIRONMENTAL CONDITIONS.

Graded terraces are widely used in agriculture. They are used to reduce soil erosion on sloped ground. A description of graded terrace systems is presented in this reference: Clifton Halsey, Modern Terraces for Soil Conservation, Agricultural Extension Service, University of Minnesota, Extension Folder 499-1980. It is currently available at: conservancy.umn.edu/handle/11299/205360

An agricultural graded terrace is a combination of a ridge and channel constructed across a slope. An agricultural terrace system is a group of agricultural graded terraces that divide a long, sloped field. It modifies the natural paths of water runoff in a field. Terraces within the agricultural terrace system are spaced at regular intervals along the slope. Each terrace collects runoff water from a section of the slope from an elevation just below the up slope terrace, down the slope to the terrace itself. The terrace ridge blocks flowing water from proceeding down the slope beyond the ridge. The captured water is contained in the channel. The agricultural graded terrace is sculpted along the contour of a field. The starting point of the agricultural graded terrace is the high point of the terrace channel. The ridge and channel are constructed to give the channel a shallow grade downward across the field. The grade of the channel is constructed to cause water to flow at a non-erosive, near-constant slow speed. The lower elevation end of each terrace channel exits into an outflow channel that carries the water from a terrace system down the slope utilizing a non-erosive channel surface such as a grass covering.

Agricultural graded terrace systems are generally constructed within the boundaries of a single agricultural property. This limits their overall size. Since agricultural terrace systems are installed in agricultural fields, the shape and size of each terrace is planned to be compatible with the operation of farm equipment upon and between the terraces. This restricts the contour of the terrace cross section and the terrace spacing with respect to adjacent terraces.

U.S. Pat. No. 2,210,218A Soil Conservation Apparatus describes a system of agricultural graded terraces for agricultural soil conservation.

A variety of excavating equipment and cultivating equipment can be used for the construction of agricultural graded terraces. These include tracked bulldozers, wheeled bulldozers, tracked excavators, backhoes, plows, discs and other types of earthmoving equipment.

Computer programs have been used for the planning of agricultural terraces for many years. The following thesis gives a review of some available computer programs for agricultural terrace design: Melissa Kay Bay, Development of an Online Planning Tool for Designing Terrace Layouts, Master of Science Thesis, University of Missouri, December 2010. It is currently available at: pdfs.semanticscholar.org/2e41/176164c5304d8596ef9d08a5edc7e0dd7c8f.pdf Modern excavation equipment used for construction of agricultural terraces can be partially controlled using computer software and associated control systems that rely on geographic positioning system (GPS) inputs. One such system is Ditch Assist and its associated software, Slope-IQ. Such systems control the positioning of the excavators to provide a terrace surface with a uniform slope along the contours of a field.

A variety of tracked vehicles are currently in use at scientific stations in Antarctica. The use of tracks on ice helps to distribute the weight of large vehicles and provides good traction. A website sponsored by the British Antarctic Survey shows how such vehicles are used. It is currently available at: www.bas.ac.uk/polar-operations/engineering-and-technology/vehicles/

A variety of wheeled vehicles have also been developed for use in off road arctic environments. Such vehicles often use large air-filled tires for better weight distribution. Some can drive on glacial ice as well as float and propel themselves across streams. One product line of such vehicles is manufactured by Burlak. The referenced website describes the line of Burlak all-terrain vehicles. They include expedition vehicles, ambulances, tow trucks, services vehicles and others. The website is currently available at: burlakoffroad.com/en/models Hydroelectric powerplants have been used for the generation of electricity for many years. Such powerplants generate a sizeable percentage of the electricity used around the world. The construction and operation of such powerplants is well understood to those who are knowledgeable in the state of the art. One reference that describes hydropower development is: Hydropower Engineering Handbook. It is currently available at: conservancy.umn.edu/handle/11299/195476

Pumped storage hydroelectric powerplants have been installed in numerous locations around the world. They are located where the geography is suitable for the construction of two reservoirs in near proximity but with substantially different elevations. The units operate by pumping water from the lower reservoir to the upper reservoir. They use electrically powered pumps during periods of slack electricity demand. The water in the upper reservoir is then sent through turbine generators located next to the lower reservoir to generate electricity during periods of high electricity demand. The water is then returned to the lower reservoir and the cycle is repeated. The construction and operation of such pumped storage powerplants is well understood to those who are knowledgeable in the state of the art.

High Voltage Direct Current HVDC submarine power transmission cables are in use in a number of locations in Europe. They provide high capacity, low line loss, long distance undersea transmission. One such system is the Western HVDC Link. A description of the Western HVDC Link is available on Wikipedia. It is currently available at: en.wikipedia.org/wiki/Western_HVDC_Link Ultra High Voltage Direct Current UHVDC overhead power transmission cables are in use in a number of locations in China. They provide high capacity, low line loss, transmission at distances of 2000 km (1240 mi) or more. One such system is the Xiangjiaba-Shanghai transmission link. A description of that link is currently available at: www.hitachienergy.com/about-us/case-studies/xiangjiaba---shanghai High Voltage Direct Current HVDC submarine power cables and Ultra High Voltage Direct Current UHVDC overhead power transmission cables are used to span long distances between locations with excess electrical power generating capacity and more highly developed regions with large electrical power needs.

SUMMARY

This summary is provided to introduce a selection of concepts in a simplified format that are further described in the detailed description of the present disclosure. This summary is not intended for determining the scope of the present disclosure.

In one embodiment of the present disclosure, a graded terrace network for collecting ice cap runoff water from areas beyond the normal catchment of a reservoir, directing that additional runoff water into the reservoir, and storing that additional water in the reservoir. Thus, increasing the volume of available water in the reservoir.

In another embodiment, a graded terrace network for collecting ice cap runoff water from areas beyond the normal catchment of a reservoir, directing that additional runoff water into the reservoir, storing that additional water in the reservoir, and using that additional water to power a hydroelectric power station. Thus, increasing the amount of electrical power that can be generated at that site.

In yet another embodiment, a graded terrace network for collecting ice cap runoff water from areas beyond the normal catchment of a reservoir, directing that additional runoff water into the reservoir, storing that additional water in the reservoir, providing a second reservoir for water storage, and providing a pump and pipes that can move water between the two reservoirs. Thus, providing additional water storage capacity for the additional stored water.

In yet another embodiment, a graded terrace network for collecting ice cap runoff water from areas beyond the normal catchment of a reservoir, directing that additional runoff water into the reservoir, storing that additional water in the reservoir, providing a second reservoir for water storage at a higher elevation than the first reservoir, providing a pump and pipes that can move water from the lower first reservoir to the second higher reservoir, providing a hydroelectric power station with a penstock from the second reservoir to the station and an outlet pipe to return water from the station into the first reservoir. Thus, providing additional water storage capacity for the additional stored water and providing a pumped storage hydroelectric power station that can move water from the lower reservoir to the upper reservoir during periods of excess electrical power capacity, and use the additional water in the upper reservoir to generate electrical power during periods of high electrical power demand.

Other features and advantages will become apparent from the following detailed description. The detailed description and the specific examples are given by way of illustration, since various changes and modifications within the spirit and scope of the present disclosure will become apparent to those skilled in the art from this detailed description.

DESCRIPTION

Brief Description of the Drawings

Examples of the present disclosure will be described in more detail, for exemplary purposes, with reference to the accompanying drawings, in which.

DETAILED DESCRIPTION

Figure 1:
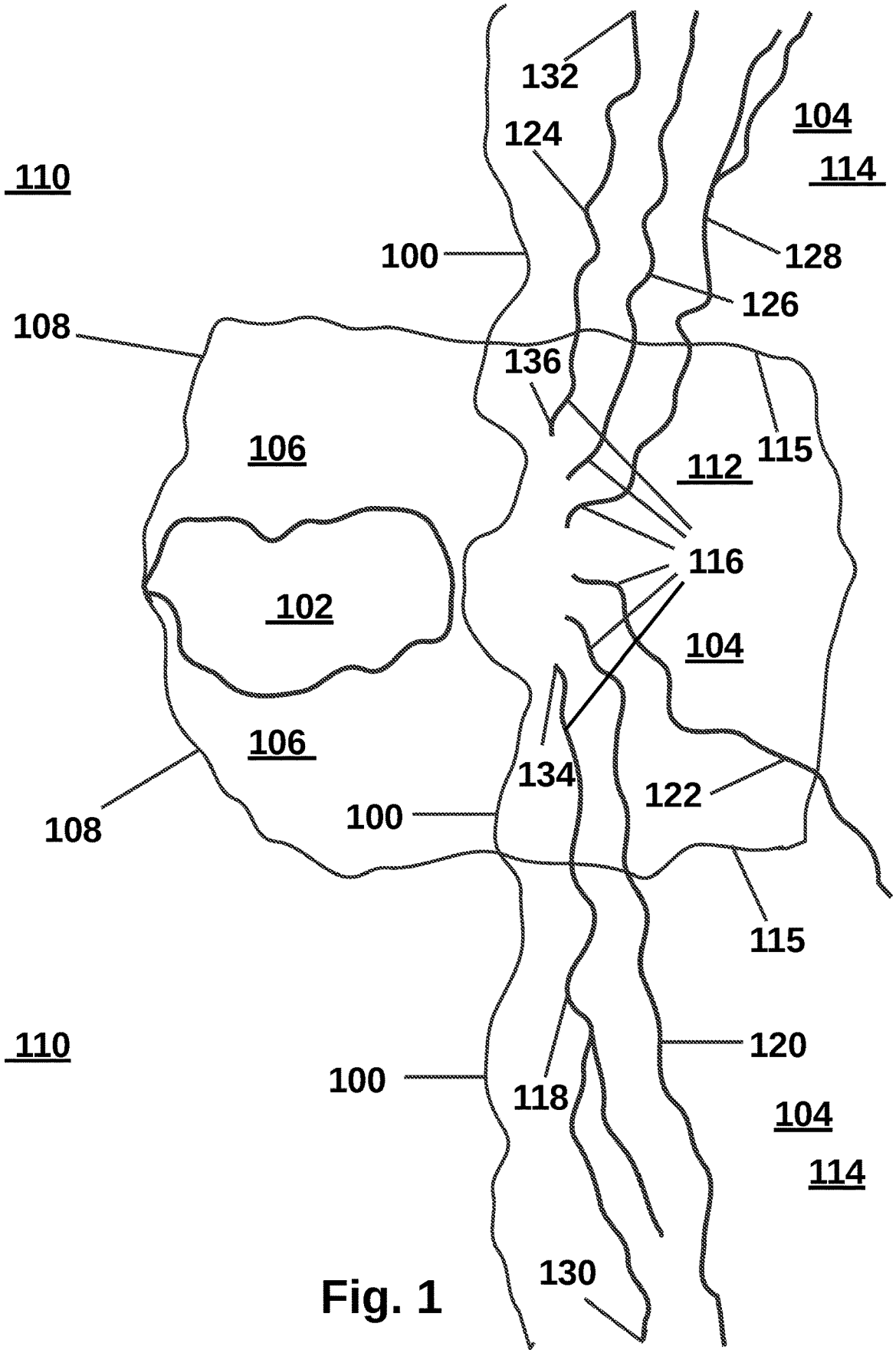
FIG. 1 is a schematic illustration of a first embodiment of an ice cap water collection and storage system according to the present disclosure.

The following detailed description refers to the accompanying drawings as listed above. The same reference numbers are used in different drawings to identify the same or similar elements. In the following description, specific details are set forth. However, it will be apparent to those skilled in the art and having the benefit of the present disclosure that the various aspects of the various embodiments may be practiced in other examples that depart from these specific details. In certain instances, descriptions of well-known devices, features, or methods are omitted so as not to obscure the description of the various embodiments with unnecessary detail.

The following is a glossary of terms that are used in this disclosure.

The term "ice cap" as used herein refers to an extremely large, relatively level area of glacial ice.

The term 'ice-free" as used herein refers to an area of terrain that is free of ice and snow for at least a part of each year.

The term "channel" as used herein refers to a physical confine consisting of a bed and banks where a stream of water flows.

The term "catchment area" as used herein refers to the entire terrain area from which water naturally drains into a lake, reservoir, or other water storage facility. A watershed.

The term "non-catchment area" as used herein refers to a terrain area outside of the catchment area to which it is associated. Water that drains from the non-catchment area does not naturally drain into the stream, lake, reservoir, or water storage facility into which the water from the catchment area drains.

The term "ice cap natural catchment area" as used herein refers to the terrain area on the ice cap from which water naturally drains into a stream, lake, reservoir, or other water storage facility.

The term "ice-free catchment area" as used herein refers to the ice-free terrain area from which water naturally drains into a stream, lake, reservoir, or other water storage facility.

The term "reservoir" as used herein refers to a natural or artificial open-air storage area where water is collected and kept in large quantity.

The term "runoff" as used herein refers to liquid water that drains from an area of ice cap terrain through the normal force of gravity.

The term "graded terrace" as used herein refers to a combination consisting of a long channel excavated from the surface of an ice cap, and a ridge constructed of glacial ice on top of the natural glacial ice, on the down slope side of the channel. It is constructed across a slope of an ice cap. Runoff water enters the channel from the up slope side of the channel. The channel has a continuous gentle slope that allows a stream of water to flow from its higher elevation starting point to its lower elevation end point.

The term "graded terrace network" as used herein refers to a group of graded terraces that divide a long, sloped area of ice cap surface.

The term "water pipe" as used herein refers to a pipe for conveying water from a reservoir to a pumping station or turbine generator, or from a pumping station or turbine generator to a reservoir or outlet stream.

The term "outlet water pipe" as used herein refers to a water pipe for conveying water from a hydroelectric power station and directing the water into a reservoir or stream.

The term "penstock" as used herein refers to a pressure vessel in the form of a water pipe that carries water from the reservoir to the turbine generator in a power station.

The term "water pump" as used herein refers to an electrically powered device that moves water through pipes by mechanical action.

The term "water transfer system" as used herein refers to a combination of structures and mechanisms that takes water from one reservoir and moves it into a second reservoir.

The term "ice cap water" as used herein refers to surface runoff from the ice cap surface. It includes liquid precipitation, snow melt runoff, and ice melt runoff.

The term "water collection system" as used herein refers to all of the structures and components that direct ice cap water runoff into graded terrace channels, direct that water into a catchment and channels the collected water into a reservoir.

The term "hydroelectric power station" as used herein refers to a plant that produces electricity by using water to propel turbine generators which in turn produce electrical power.

The term "hydroelectric power generation" as used herein refers to the process of producing electricity by using water to propel turbine generators which in turn produce electrical power.

The term "pumped hydroelectric power generating station" as used herein refers to a plant that utilizes two reservoirs at different elevations. The station includes a water pump that pumps water from the lower reservoir to the upper reservoir during periods when excess electrical power is available. The station includes a hydroelectric power station that uses the water in the upper reservoir the produce electrical power during periods of high electricity demand. The water is then returned to the lower reservoir for reuse.

The term "turbine generator" as used herein refers to a machine that uses a stream of water to turn a wheel connected to an electric generator and thus to produce electrical power.

One embodiment of the ice cap water collection and storage system is illustrated in FIG. 1. FIG. 1 depicts a plan view of a geographic area with north at the top of the figure. The ice cap western edge 100 runs in a curvy, but generally north-to-south direction dividing the geographic area. A reservoir 102 is located to the west of the ice cap western edge 100. The ice cap 104 covers the entire area east of the ice cap western edge 100. An ice-free catchment area 106 surrounds the reservoir 102. The ice-free catchment area boundary 108 defines the limit of the ice-free catchment area 106 to its north, east, and south. The eastern edge of the ice-free catchment area 106 is the ice cap western edge 100. The ice-free catchment area 106 is the entire ice-free area within which, precipitation that falls, will naturally drain into reservoir 102. Since precipitation that falls directly into reservoir 102 is also collected into it, the area of reservoir 102 can also be considered a part of the ice-free catchment area 106. The ice-free non-catchment area 110 includes all of the area to the west of the ice cap western edge 100 that is not within the ice-free catchment area 106. Precipitation that falls within the ice-free non-catchment area 110 does not drain into reservoir 102.

All of the area to the east of the ice cap western edge 100 is covered in glacial ice year-round. Ice cap natural catchment area 112 is a geographic area within which surface runoff including, liquid precipitation, snow melt runoff, and ice melt runoff, drains and enters into the ice-free catchment area 106, and then into the reservoir 102. The ice cap non-catchment area 114 includes all of the area to the east of the ice cap western edge 100 that is not within the ice cap natural catchment area 112. The ice cap natural catchment area boundary 115 indicates the northern eastern, and southern edges of the ice cap natural catchment area 112. Ice cap western edge 100 forms the western boundary between the ice cap natural catchment area 112 and ice-free catchment area 106. Ice cap western edge 100 also forms the western boundary between the ice cap non-catchment area 114 and ice-free non-catchment area 110.

Figure 2:
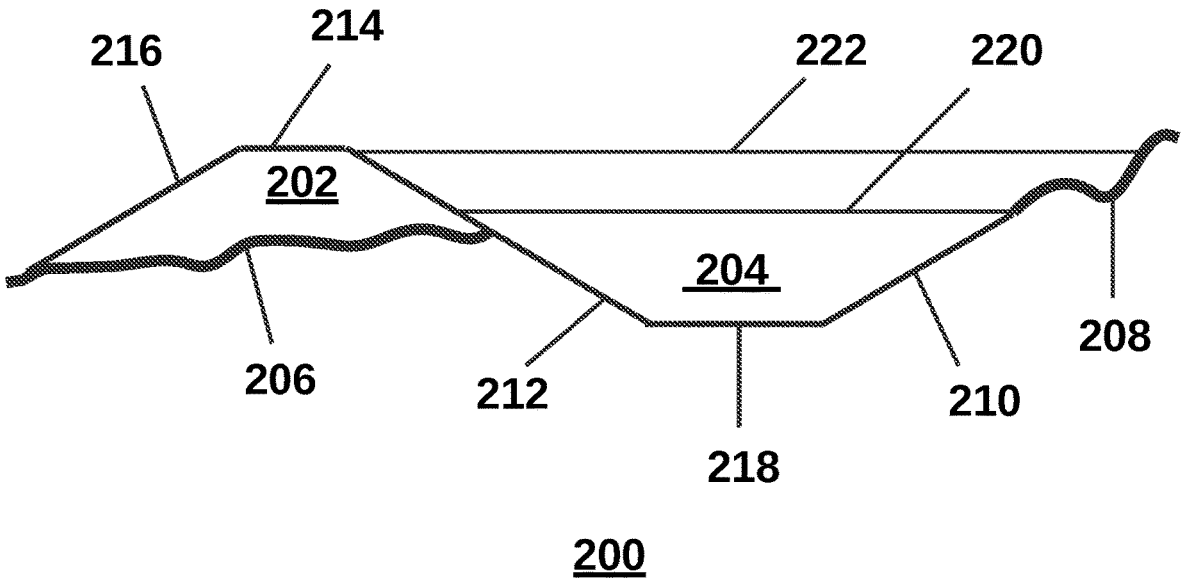
FIG. 2 is a cross-sectional view of an ice cap graded terrace.

A cross sectional view of a graded terrace is shown in FIG. 2. A graded terrace is constructed on the natural glacial ice 200 of an ice cap. It is a combination of a graded terrace ridge 202 constructed of excavated glacial ice on top of the natural glacial ice 200, and a graded terrace channel 204 excavated from the glacial ice 200. A graded terrace is constructed across a slope on the surface of an ice cap. The graded terrace ridge 202 is constructed on the down slope natural ice cap surface 206. Ice cap surface runoff enters the graded terrace channel 204 from the up slope natural ice cap surface 208. The graded terrace ridge 202 blocks the runoff from proceeding down slope from the channel. Therefore, it is retained in the channel and travels in the down stream direction toward the end of the graded terrace. The profile of the graded terrace channel 204 has gently sloping sides including a graded terrace cut slope 210 on the up slope side, and a graded terrace front slope 212 on the down slope side. The graded terrace front slope extends to the graded terrace ridge top 214. The graded channel ridge back slope 216 extends in a gentle slope from the ridge top 214 to the down slope natural ice cap surface 206. The graded terrace channel bottom 218 is flat. The stream surface 220 illustrates that during most operating periods the channel will operate at less than maximum capacity. During warm periods higher ice melt rates will cause increased runoff. During such periods the water level can reach the runoff stream maximum capacity 222. This graded terrace cross sectional profile is what is presently contemplated for this embodiment but other configurations can be used.

Six graded terraces are shown in FIG. 1. They are designated as southern graded terrace nearest ice cap edge 118, second southern graded terrace 120, third southern graded terrace 122, northern graded terrace nearest ice cap edge 124, second northern graded terrace 126, third northern graded terrace 128. These six graded terraces form one example of an ice cap graded terrace network 116.

As discussed in the Background Art section above, the contour of the ice cap in the southwestern region of Greenland consists of a gently sloping plane with maximum elevation in the central ridge and dropping elevations toward the west. The slope increases near the western edge of the ice cap. The ice cap in the southwestern region of Greenland has a nearly level slope in the north-south direction. The ice cap depicted in FIG. 1 has the same general slope as the ice cap in the southwestern region of Greenland.

Considering the slope of the ice cap, southern graded terrace nearest ice cap edge 118, is positioned at a lower elevation than second southern graded terrace 120, which is at a lower elevation than third southern graded terrace 122. Similarly, northern graded terrace nearest ice cap edge 124 is positioned at a lower elevation than second northern graded terrace 126, which is at a lower elevation than third northern graded terrace 128.

The graded terrace network 116 modifies the natural paths of water runoff from the ice cap surface. Individual graded terraces within the graded terrace network 116 are spaced at regular intervals along the slope of the ice cap surface. Each graded terrace collects runoff water from a section of the slope surface, from an elevation just below the up slope graded terrace, down the slope to the graded terrace itself. The graded terrace ridge blocks flowing water from proceeding down the slope beyond the ridge. The captured water is contained in the channel. The graded terrace is sculpted along the contour of the ice cap.

The starting point of the graded terrace is the high point of the graded terrace channel. Start point of southern graded terrace nearest ice cap edge 130 is the high point of southern graded terrace nearest ice cap edge 118. Similarly, start point of northern graded terrace nearest ice cap edge 132 is the high point of northern graded terrace nearest ice cap edge 124. Termination point of southern graded terrace nearest ice cap edge 134 is the low point of southern graded terrace nearest ice cap edge 118. Similarly, termination point of northern graded terrace nearest ice cap edge 136, is the low point of northern graded terrace nearest ice cap edge 124. The ridge and channel are constructed to give the channel a shallow grade downward across the ice cap. The grade of the channel is constructed to cause water to flow at a non-erosive, near-constant slow speed. The lower elevation end of each ice cap graded terrace channel exits into the ice cap natural catchment area 112. Each graded terrace starts in the ice cap non-catchment area 114, collects runoff from that area and directs it into the ice cap natural catchment area 112. This effectively expands the ice cap natural catchment area 112 thus increasing the quantity of runoff that is directed into reservoir 102. This additional stored water can be used for agricultural irrigation, hydroelectric power generation, drinking water, recreation, and numerous other uses.

The end point of each graded terrace, 118, 120, 122, 124, 126 and 128, terminates within the ice cap natural catchment area 112. The end points are spaced across the catchment so that the runoff is distributed in a way that distributes the erosive effect of the runoff relatively evenly across the face of the ice cap natural catchment area 112.

The embodiment of the system illustrated in FIG. 1 shows a graded terrace network 116 consisting of six graded terraces. This layout is illustrated to aid in the understanding of the graded terrace approach. This specific configuration is one possible embodiment of the graded terrace network 116 but other configurations can be used. In some anticipated embodiments, the overall size of the graded terrace network 116 and the number of terraces will be dramatically larger than the number shown in FIG. 1.

Figure 3:
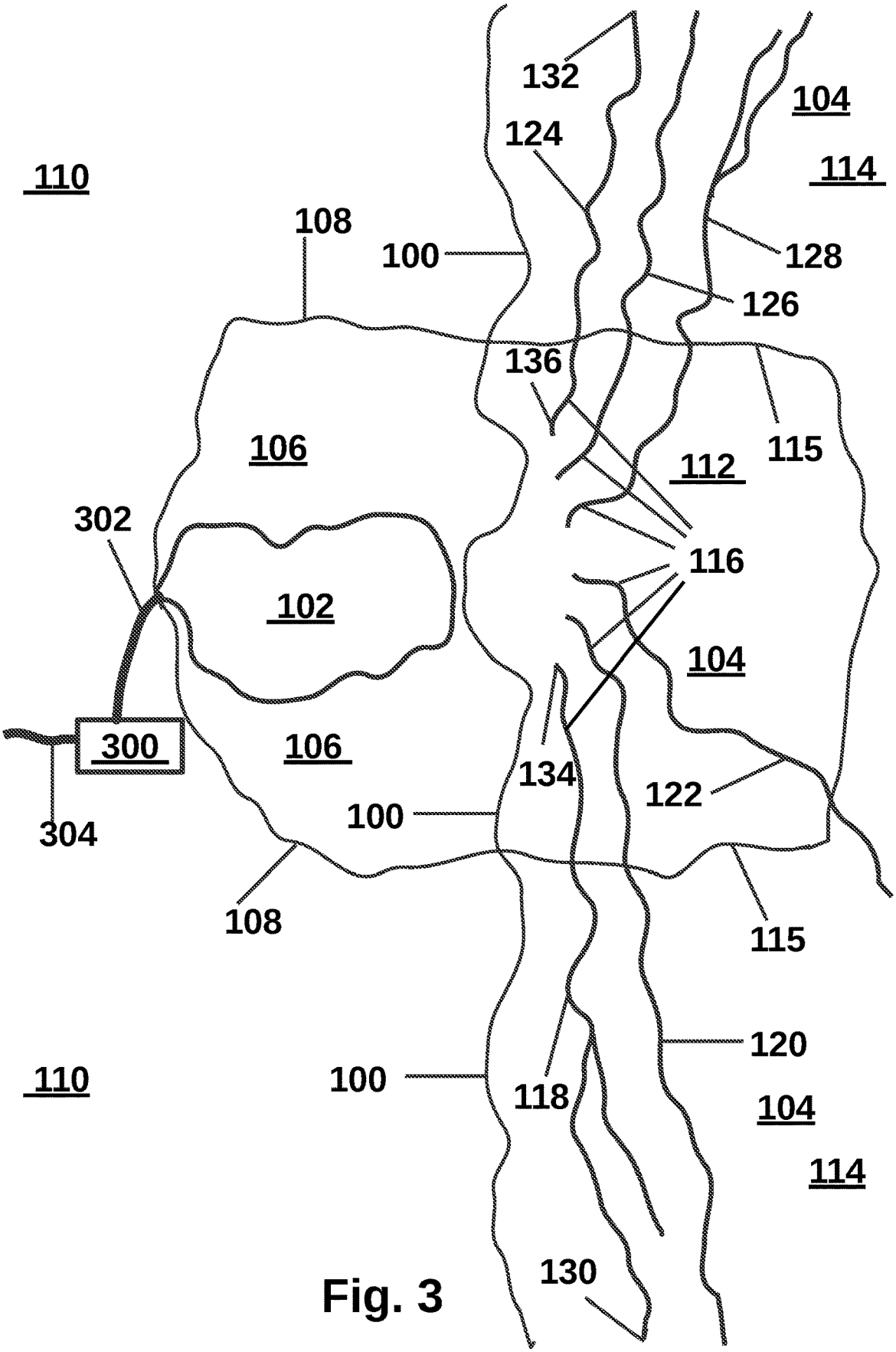
FIG. 3 is a schematic illustration of a second embodiment of an ice cap water collection and storage system that includes a hydroelectric power generation system according to the present disclosure.

A second embodiment of the system is illustrated in FIG. 3. FIG. 3. depicts the same geographic area shown in FIG. 1 and described in the first embodiment above. All of the parts described in FIG. 1 are included in FIG. 3. The entirety of embodiment 1 is included in this second embodiment. FIG. 3 also shows hydroelectric power station 300, penstock 302 and outlet water pipe 304. Hydroelectric power station 300 is located at an elevation substantially below the water level of reservoir 102. Water stored in reservoir 102 enters penstock 302. The water flows through penstock 302 and is directed through a turbine generator within hydroelectric power station 300 to generate electricity. The water then exits the hydroelectric power station 300 through outlet water pipe 304.

The Tasersiaq Lake area of southwestern Greenland offers an example of a site whose features correspond to the features of the second embodiment as illustrated in FIG. 3. Tasersiaq Lake in southwestern Greenland is a large lake that extends for over 65 km (40 mi) from the western edge of the Greenland ice cap. It lies at an elevation of 680 m (2,230 ft) above sea level. The western end of the lake is within 26 km (16 mi) of an ocean inlet, known as Evighedsfjord, that opens into the Davis Strait near the settlement of Kangaamiut. The Greenland ice cap terminates directly along the eastern edge of the lake and its ice-free catchment area, for a distance in excess of 30 km (19 mi). These geographic attributes make it a suitable candidate for hydropower development.

The Greenland Hydropower Project Site 7e, Prefeasibility Report by AECOM Tecsult Inc., referred to in the Background section above, examined the potential of the Tasersiaq Lake area for the production of hydroelectric power. AECOM Tecsult is a large division of AECOM Technology Corporation a leading provider of professional technical and management support services for government and commercial clients around the world. The Tecsult division specializes in hydropower expertise which it represents as a primary strength of the approximately 1,100 employee division. They are therefore knowledgeable in the state of the art. The Greenland Hydropower Project Site 7e, Prefeasibility Report describes a hydroelectric project at Tasersiaq Lake designed to provide electrical power to a proposed aluminum smelter nearby. The report states that the proposed smelter consumed 650 megawatts of electrical power. The Tasersiaq Lake project proposed in the report provided an estimated 533 megawatts of electrical power which is less than that total. In spite of the shortfall the report did not anticipate, nor consider, nor suggest, nor propose, the use of a graded terrace network to increase water collection and to thereby increase the project electricity generating capacity. Had the use of a graded terrace network for runoff water collection been within this company's state of the art knowledge, it is likely that it would have been mentioned in this report as a means to increase the power generating capacity and overcome the power generation deficiency of the project.

It has been widely reported that the Greenland ice cap experiences extensive melting during approximately 100 days each summer. The amount of melting is especially large along the southwestern parts of the ice cap near Tasersiaq Lake.

Collection of ice cap runoff over a large area of the ice cap can dramatically increase the potential for hydroelectric power generation at the Tasersiaq Lake site. The geography of the ice cap in the area east of Tasersiaq Lake has been discussed in the Background section above. This geography is suitable for the collection of runoff over a roughly semi-circular area extending east, north, and south of Tasersiaq Lake and centered just east of the lake. The area suitable for collection has a radius of approximately 180 km (112 mi) or more and an area of approximately 50,000 km^2 (19,300 mi^2) or more.

The Tasersiaq Lake example of the second embodiment utilizes a graded terrace network sculpted on the ice cap surface to collect ice cap runoff over a wide area. The graded terrace network is comprised of a multiplicity of graded terraces that collect and carry the runoff from the far reaches of this approximate 50,000 km^2 (19,300 mi^2) collection area using gravity flow into the lake catchment area. From there it drains naturally into the impounded lake.

The cross-sectional size of each terrace channel, its gradient, which determines stream flow rate, and its spacing with respect to adjacent terraces, which determines its collection area, are selected to optimize the collection efficiency of the graded terrace network.

The ice sheet east of Tasersiaq Lake within the proposed collection area has lost approximately 2.2 meters (7.2 ft) of ice depth over the past 20 years, or an average of 0.11 m (0.36 ft) per year. This is discussed in the report titled; GRACE Tellus Gravity Recovery & Climate Experiment, Greenland Ice Loss 2002-2021, that is referenced in the Background section above. The HIRHAM5 precipitation model predicts that the estimated annual precipitation rate on the ice sheet east of Tasersiaq Lake is 0.33 m/yr (1.08 ft/yr). This is based on FIGS. 4*c* and 4*f* of report; Very high resolution regional climate model simulations over Greenland: Identifying added value, which is referenced in the Background section above.

The total average runoff depth is then approximately equal to the sum of the average annual ice mass loss depth plus the average annual precipitation, or 0.44 m/yr (1.44 ft/yr). Total annual melt runoff within the 50,000 km^2 (19,300 mi^2) collection area is then equal to the runoff depth times the collection area or 22 km^2 (5.3 mi^2). The melt season averages approximately 100 days per year. So, the average runoff rate within the collection area is 0.22 km^2 (0.053 mi^2) per day. Some days have higher than average melt rates. To account for these days the channels are sized to handle a max flow rate of 0.44 km^2 (0.106 mi^2 per day which is twice the average daily melt rate.

Using standard engineering equations for terrace channel stream flow rate, based upon the slope of the ice cap, channel cross section and channel roughness, it is estimated that the minimum expected stream flow rates will be approximately 1.3 m/sec (4.3 ft/sec). A graded terrace stream with a 6 m^2 (65 ft^2) cross section and flowing at 1.3 m/sec (4.3 ft/sec) will carry approximately 6.7*10^5 m^3 (2.4*10^7 ft^3) of water per day from the ice sheet collection area into Tasersiaq Lake. Then approximately 660 graded terraces of the same size will carry the runoff from the entire collection area on a max flow rate day. A graded terrace channel cross section is illustrated in FIG. 2. The cross section is the area bounded by up slope natural ice cap surface 208, graded terrace cut slope 210, channel bottom 218, graded terrace front slope 212, and runoff stream maximum capacity level 222.

In the construction of the Tasersiaq Lake graded terrace network, each graded terrace will terminate within the ice cap catchment area of Tasersiaq Lake. Each graded terrace will extend out from that point into the ice cap non-catchment area toward the most distant outer edge of the collection area approximately 180 km (112 mi) from the termination point near Tasersiaq Lake. Since each graded terrace will follow the contours of the glacial topography the actual length of each graded terrace will be greater than 180 km (112 mi).

Each graded terrace may contain branches in its outer reaches to improve collection efficiency. These branches, which will carry smaller quantities of water than the main channel, can have a shallower and narrower cross section. The combined cross section of all branches of a single graded terrace will decrease as it approaches the far end of the channel.

FIG. 2 shows a graded terrace channel 204 cut into the natural glacial ice 200 and a graded terrace ridge 202 built upon the ice cap surface. In order to maintain the graded terrace contour the construction may vary from this profile. In some areas ice may be added to low lying areas and then the graded terrace built upon the added ice. In other areas a deeper excavation may be needed through an area to maintain the uniform grade.

Moulins are holes in the ice that allow water to drain from the ice cap surface to the base rock below. Each moulin has a catchment area from which ice cap runoff drains into the moulin. In order to collect water within the moulin catchment area a channel cut can be excavated at a low point in the catchment area edge. A graded terrace will then be constructed within the moulin catchment area. In some instances, moulins may be plugged with ice cap ice from the immediate surrounding area, in coordination with terracing. These techniques will cause most of the runoff to be blocked from entering the moulins and thus, retained on the ice cap surface and directed into the graded terrace channels.

Crevasses are large cracks in the ice cap surface. They can be tens of meters deep. In order to construct a graded terrace across a crevasse, the crevasse crack will be filled in the immediate vicinity of the graded terrace path and then the graded terrace will be excavated across the crevasse within the ice fill.

Some irregular areas of the ice cap surface are too irregular to warrant the construction of graded terraces within those areas. For such irregular areas the graded terraces will be routed around the unsuitable areas.

Construction and maintenance of the graded terrace network represents a major undertaking. Channel excavation will be planned for a 5-month period each year extending from May through September. It is estimated that an average of 120 days will be suitable for work on the ice cap during each year.

Modern agricultural terracing projects often rely on the use of specialized terracing software with geographic positioning systems (GPS) to establish graded terrace network layouts and to control terracing equipment to maintain accurate grade control. A system of this type will be selected for use on this project.

The actual excavation of each graded terrace will be performed using a bulldozer with an adjustable front blade and an aft ripper. It will be operated utilizing GPS controls for proper contour following and grade control. The ripper will be used to break up the glacial ice to the desired depth. The blade will be used to remove the broken ice to form a channel of the desired cross section and to push the broken chunks of ice onto the down slope side of the channel. The chunks of ice will be sculpted into a ridge.

Excavation of each channel will begin at the Tasersiaq Lake catchment area end of the channel and will proceed outward from that point along a nearly uniform sloped grade following the terrain contours. During the melt season this approach will allow excavation with the least water present in the channel work area during excavation.

Each bulldozer will be operated on a 16 hr. per day 7 day per week basis with stoppages for unplanned maintenance and unacceptably bad weather. It is estimated that 12 hours per day will be devoted to excavation and the remainder to maintenance and other activities. To execute this schedule, three operators will be assigned to each work crew. Two operators will be on-site at any time with a third having days off.

In addition to the bulldozer, each crew will also have one service vehicle on-site. The service vehicle will be an arctic all-terrain vehicle. It will be configured with large fuel tanks and other supplies and tools to support operation of the bulldozer. The crew compartment will be configured with living quarters to support a two-man crew for several days. Each operator will work an 8-hour shift while the other rests or relaxes. The third crew member will rotate to the work site relieving one crew member by using a second arctic all-terrain vehicle. One crew member will drive the first arctic all-terrain vehicle back to a service center. That crew member will be off duty for several days until returning to the work site with more supplies and to relieve the other crew member.

While one size channel cross section is described above it is anticipated that a range of channel sizes will be used. The routes of individual terraces will be selected for ease of construction and efficiency of runoff collection. The cross section will then be established based upon the surface area from which runoff drains into that graded terrace.

The specific construction equipment and approach described above is what is presently contemplated for this embodiment. However, other construction techniques can also be used to complete the construction of the graded terrace network.

Maintenance of the graded terrace network will occur on an ongoing basis extending throughout the expected life of the project. Excavating equipment and operating techniques that are similar to those used for construction will be used to repair graded terrace channels and ridges so that adequate capacity and flow are maintained.

The capacity of Tasersiaq Lake will be expanded by building three rock-fill dams. One dam will be at the western end of the lake. A second dam will be to the south of the lake approximately 10 km (6.2 mi) southeast of the first dam. The third dam will be near the eastern end of the lake between the northern and southern sections of the lake. The three dams will impound water to an elevation of approximately 800 m (2,620 ft), which is approximately 120 m (394 ft) above the natural water level of 680 m (2,230 ft). This reservoir will add approximately 16 km^3 (3.8 mi^3) to the lake's capacity.

The ice cap extends to nearly the eastern edge of the north section of Tasersiaq Lake. There is a narrow low exposed rock moraine separating the lake shore from the ice cap. It is unclear whether the elevation of the rock moraine beneath the ice cap rises to an elevation of 800 m (2,620 ft) or above. The third dam provides a secure impoundment at the eastern end of the south leg to preclude any outflow from the moraine area.

The dam at the east end of Tasersiaq Lake impounds the ice cap runoff in a reservoir to its west. It also blocks water in the north section of Tasersiaq Lake from exiting via the existing channel toward the west. It is expected that up to 0.2 km^3 (0.05 mi^3) of runoff will accumulate in the area on a yearly basis. A water pumping station will be installed at the east dam to pump water from the north section of Tasersiaq Lake into the reservoir west of the dam. It can then be used for additional hydroelectric power generation.

Most of the glacial melting occurs during an approximate 100-day period in the summer. The reservoir allows a large share of the summer runoff to be stored and then used to generate hydroelectric power during the remaining fall, winter, and spring periods.

The specific configuration of dams described herein are what is presently contemplated for this embodiment. Other configurations can be used to achieve the desired water storage result.

A combination of conventional HVDC submarine cables (not shown) coupled with UHVDC overhead power cables (not shown), as described in the Background section above, can be constructed. Such a system can originate at the Tasersiaq Lake power generation site and proceed to the western coast of Greenland as a UHVDC overhead power transmission line. From there, HVDC submarine power cables can carry power to a point on the northeastern coast of Canada. From there a second UHVDC overhead power transmission line can carry power to customers in southern Canada and the northeastern United States.

The added water collected and stored using the graded terrace network and expanded reservoir dramatically increase the power generating potential of the site. Collecting runoff over a wide expanse using a graded terrace network, storing the collected water in an expanded reservoir, using the water for power generation, and transmitting the power to customers in southern Canada and the northeastern United States will provide up to 3.9 gigawatts of additions renewable energy on a year-round basis to those customers. This is 34 billion kilowatt hours per year, an amount sufficient to provide electrical power for roughly 4 million residential customers.

Figure 4:
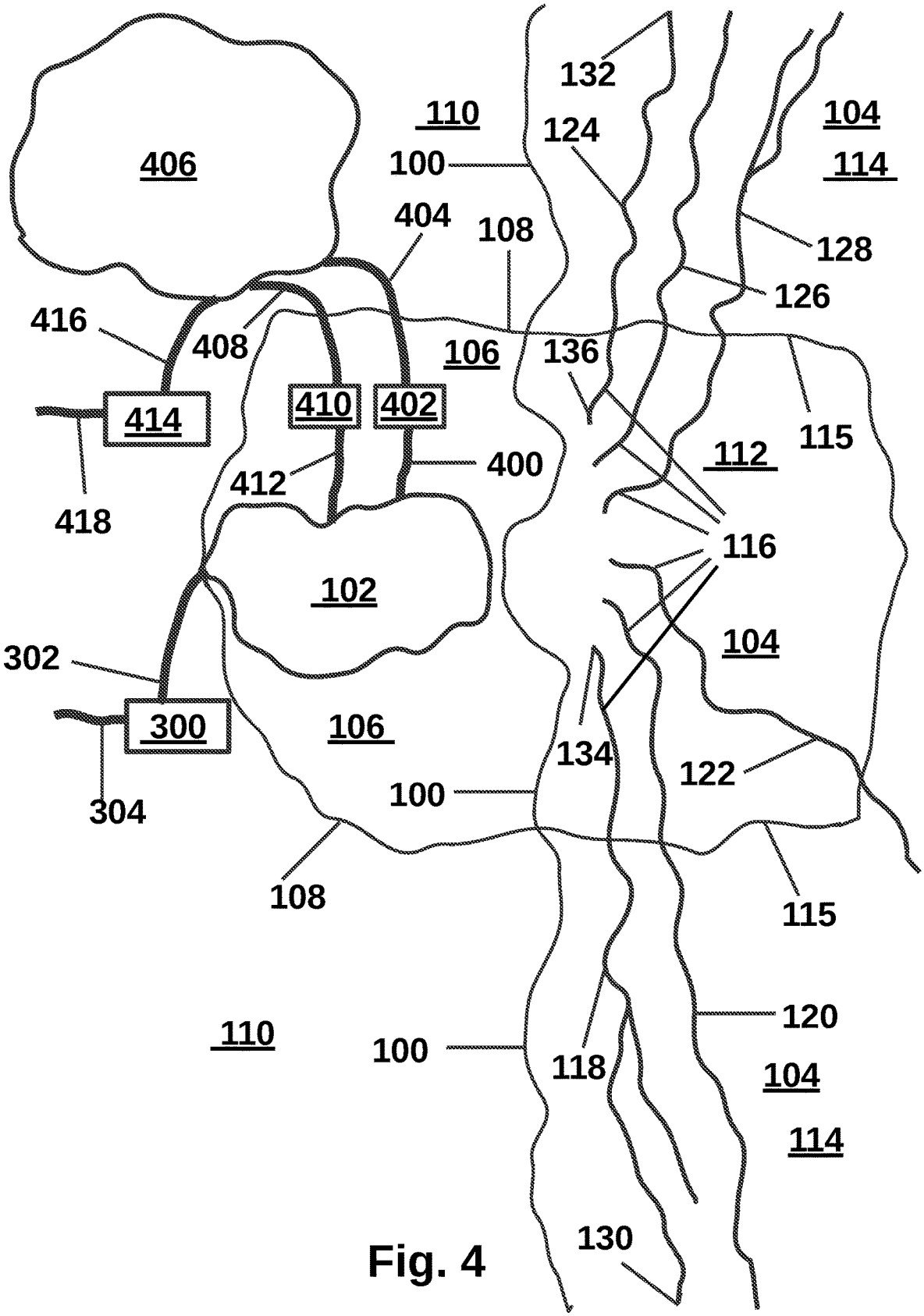
FIG. 4 is a schematic illustration of a third embodiment of an ice cap water collection and storage system with more than one reservoir, a water transfer system and additional hydroelectric power generation systems.

A third embodiment of the system is illustrated in FIG. 4. FIG. 4. depicts the same geographic area shown in FIG. 1 and described in the first embodiment above. All of the parts described in FIG. 1 are included in FIG. 4. The entirety of the first embodiment described above is included in this third embodiment. The following parts of FIG. 4 are included in this third embodiment. A first water pipe 400 connected to reservoir 102 and to water pump 402. Water pump 402 connected to second water pipe 404 which is connected to second reservoir 406. Water pump 402 draws water from reservoir 102, through first water pipe 400, and pumps that water through second water pipe 404, and into second reservoir 406. The action of the water pump 402 can be reversed. In that operating condition, water pump 402 draws water from second reservoir 406, through second water pipe 404, and pumps that water through first water pipe 400 and into reservoir 102.

A fourth embodiment of the system is illustrated in FIG. 4. FIG. 4. depicts the same geographic area shown in FIG. 1 and described in the first embodiment above. All of the parts described in FIG. 1 are included in FIG. 4. The entirety of the third embodiment described above is included in this fourth embodiment. The following parts of FIG. 4 are included in this fourth embodiment. A second penstock 408, connected to second reservoir 406 and to second hydroelectric power station 410. Second hydroelectric power station 410 connected to second outlet water pipe 412 which is connected to reservoir 102. In this embodiment second reservoir 406 is located at a higher elevation than reservoir 102. Second hydroelectric power station 410, which is located near the elevation of reservoir 102, receives water at high pressure from second reservoir 406 through penstock 408. This water is used to drive a turbine generator within second hydroelectric power station 410 which produces electricity. That water then exits second hydroelectric power station 410 through second outlet water pipe 412 and from there is directed into reservoir 102 where it is stored for later use.

By utilizing the water pumping system described in the third embodiment to pump water from reservoir 102 into second reservoir 406, and by utilizing the hydroelectric power station system described in this fourth embodiment to generate electricity, a pumped hydroelectric power generating station is created. In this configuration, during periods when excess electrical power is available, water is pumped from the lower reservoir 102 into the upper second reservoir 406. During periods of high electrical demand water stored in the upper second reservoir 406 is directed through second hydroelectric power station 410 to generate electricity and then the water is returned to reservoir 102 for reuse.

A fifth embodiment of the system is illustrated in FIG. 4. FIG. 4. depicts the same geographic area shown in FIG. 1 and described in the first embodiment above. All of the parts described in FIG. 1 are included in FIG. 4. The entirety of embodiment 4 is included in this fifth embodiment. FIG. 4 also shows third hydroelectric power station 414, third penstock 416, and third outlet water pipe 418. Third hydroelectric power station 414 is located at an elevation substantially below the water level of second reservoir 406. Water stored in second reservoir 406 enters third penstock 416. The water flows through third penstock 416 and is directed through a turbine generator within third hydroelectric power station 414 to generate electricity. The water then exits third hydroelectric power station 414 through third outlet water pipe 418.

PART NAMES

100 ice cap western edge
102 reservoir
104 ice cap
106 ice-free catchment area
108 ice-free catchment area boundary
110 ice-free non-catchment area
112 ice cap natural catchment area
114 ice cap non-catchment area
115 ice cap natural catchment area boundary
116 graded terrace network
118 southern graded terrace nearest ice cap edge
120 second southern graded terrace
122 third southern graded terrace
124 northern graded terrace nearest ice cap edge
126 second northern graded terrace
128 third northern graded terrace
130 start point of southern graded terrace nearest ice cap edge
132 start point of northern graded terrace nearest ice cap edge
134 end point of southern graded terrace nearest ice cap edge
136 end point of northern graded terrace nearest ice cap edge
200 glacial ice
202 graded terrace ridge
204 graded terrace channel
206 down slope natural ice cap surface
208 up slope natural ice cap surface
210 graded terrace cut slope
212 graded terrace front slope
214 graded terrace ridge top
216 graded terrace ridge back slope
218 graded terrace channel bottom
220 runoff stream surface
222 runoff stream maximum capacity
300 hydroelectric power station
302 penstock
304 outlet water pipe
400 first water pipe
402 water pump
404 second water pipe
406 second reservoir
408 second penstock
410 second hydroelectric power station
412 second outlet water pipe
414 third hydroelectric power station
416 third penstock
418 third outlet water pipe

The invention claimed is:

1. An ice cap water collection and storage system, comprising;

a reservoir in the form of a naturally formed or dammed open air lake in the ice free zone near an ice cap, within which water is stored;

a natural catchment area of said reservoir consisting of an ice cap natural catchment area of said reservoir on the surface of the ice cap and an ice free natural catchment area of said reservoir in areas not covered by ice;

a graded terrace network comprised of a plurality of graded terraces, with each said graded terrace comprised of an excavated channel and a ridge constructed on the down slope side of said excavated channel, and constructed of ice on the surface of the ice cap, with each said graded terrace beginning on the ice cap surface at a point outside of said ice cap natural catchment area and terminating on the ice cap surface within said ice cap natural catchment area, and with each said graded terrace both collecting said ice ca water directly from said ice cap surface both within and outside of said natural catchment area, and directing flow upon said ice cap surface of said ice cap water to the terminus of each said graded terrace within said natural catchment area;

a graded terrace construction and maintenance system comprised of mechanical excavators and service vehicles that are used to excavate said graded terrace channels and construct said graded terrace ridges, and to maintain said graded terraces;

said natural catchment area that directs said ice cap water into said reservoir;

and said reservoir that stores said ice cap water.

2. The ice cap water collection and storage system of claim 1, further comprising a hydroelectric power station, a penstock, and an outlet water pipe wherein;

said ice cap water stored in said reservoir is directed through said penstock, then through said hydroelectric power station to generate electricity, and finally through said outlet water pipe.

3. The ice cap water collection and storage system of claim 1, further comprising a second reservoir and a water transfer system wherein;

said water transfer system moves said ice cap water between said reservoir and said second reservoir.

4. The ice cap water collection and storage system of claim 3, wherein;

said water transfer system is comprised of;

a water pump;

a first water pipe connected to said reservoir and to said water pump;

a second water pipe connected to said water pump and to said second reservoir;

and said water pump that pumps said ice cap water between said reservoir, and said second reservoir, via said first water pipe and said second water pipe.

5. The ice cap water collection and storage system of claim 4, further comprising a second hydroelectric power generating system, a second penstock, and a second outlet water pipe wherein;

said second penstock connects said second reservoir to said second hydroelectric power generating system;

said second outlet water pipe connects said second hydroelectric power generating system to said reservoir;

said second reservoir is located at a higher elevation than said reservoir;

said second hydroelectric power generating system is located at approximately the same elevation as said reservoir;

said water pump pumps water from said reservoir into said second reservoir;

said second hydroelectric power generating system utilizes water stored in said second reservoir to generate electricity.

6. The ice cap water collection and storage system of claim 5 further comprising a third hydroelectric power generating system, a third penstock, and a third outlet water pipe wherein;

said third penstock connects said second reservoir to said third hydroelectric power generating system, said third outlet water pipe is connected to said third hydroelectric power generating system, said third hydroelectric power generating system is located at a lower elevation than said second reservoir;

said ice cap water stored in said second reservoir is directed through said third hydroelectric power generating system to generate electricity.

7. A method of collecting and storing ice cap water comprising;

(a) providing a reservoir in the form of a naturally formed or dammed open air lake, in the ice free zone near an ice cap, within which water is collected and stored, (b) providing a natural catchment area of said reservoir consisting of an ice cap natural catchment area of said reservoir on the surface of the ice cap and an ice free natural catchment area of said reservoir in areas not covered by ice cap ice, (c) providing a graded terrace network comprised of a plurality of graded terraces, with each said graded terrace comprised of an excavated channel and a ridge constructed on the down slope side of said excavated channel, and constructed of ice on the surface of the ice cap, constructed with each said graded terrace beginning on the ice cap surface at a point outside of said ice cap natural catchment area and terminating on the ice cap surface within said ice cap natural catchment area, (d) collecting said ice cap water that flows as runoff upon the ice cap surface into said graded terraces of said graded terrace network, (e) directing said ice cap water in said graded terraces of said graded terrace network to flow to the terminus of each said graded terrace and from there into said natural catchment area, (f) directing said ice cap water in said natural catchment area to flow into said reservoir, (g) providing a graded terrace construction and maintenance system comprised of mechanical excavators and service vehicles that are used to excavate said graded terrace channels and construct said graded terrace ridges, and to maintain said graded terraces;

whereby the quantity of water collected and stored in said reservoir is increased by the quantity collected by said graded terrace network.

8. The method of claim 7, further comprising providing, a method of hydroelectric power generation that utilizes the increased quantity of stored water;

whereby the quantity of electricity generated by said method of hydroelectric power generation is increased through the utilization of the increased quantity of water, collected by said graded terrace network and stored in said reservoir.

9. The method of claim 7, further comprising:

(a) providing a second reservoir, (b) transferring water between said reservoir and said second reservoir, whereby the quantity of water that can be stored is increased.

10. The method of claim 7, further comprising:

(a) providing a second reservoir positioned at a higher elevation than said reservoir, (b) transferring water between said reservoir and said second reservoir by utilizing electrically powered water pumps, (c) using said water stored in said second reservoir as a source of power for hydroelectric power generation;

(d) returning said water to said reservoir after use for said hydroelectric power generation, whereby potential energy is stored by pumping said water from said reservoir into said second reservoir, utilizing said electrically powered water pumps during periods of low electricity demand, and using said stored water from said second reservoir to produce electricity during periods of high electricity demand.

* * * * *